US006158733A

United States Patent [19]

Muraki

[11] Patent Number: 6,158,733

[45] **Date of Patent: *Dec. 12, 2000**

[54] SHEET FEEDER FOR FEEDING SHEETS OF DIFFERENT RIGIDITY

[75] Inventor: Motohito Muraki, Nagoya, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/078,564

[22] Filed: May 14, 1998

[30] Foreign Application Priority Data

May 15, 1997 [JP] Japan ..... 9-125614

[51] Int. Cl.[7] ..... B65H 1/08

[52] U.S. Cl. ..... 271/127; 271/121; 271/124; 271/18; 271/104; 271/137; 271/167; 271/10.11

[58] Field of Search ..... 271/121, 124, 271/18, 104, 137, 167, 10.11

[56] References Cited

U.S. PATENT DOCUMENTS 5,857,671 1/1999 Kato et al. ..... 271/10.11

5,895,040 4/1999 Oleksa et al. ..... 271/124

FOREIGN PATENT DOCUMENTS 7-304527 11/1995 Japan .

*Primary Examiner*—Christopher P. Ellis
*Assistant Examiner*—Richard Ridley
*Attorney, Agent, or Firm*—Oliff & Berridge, PLC

[57] ABSTRACT

A sheet feeder includes a support plate inclined backward and a feed roller for feeding one by one the sheets of paper stacked on the plate. A first support surface and a second support surface are formed at or near the bottom of the plate to support the front ends of the sheets. The second surface is lower in frictional resistance than the first surface. The second surface can be moved by an operating lever between a first position, where it is protruded from the first surface toward the sheets, and a second position, where it is retracted from the first surface away from the sheets. If the sheets are relatively rigid, their front ends are supported by the second surface in the first position, and they can therefore be fed smoothly.

23 Claims, 6 Drawing Sheets

SHEET FEEDER FOR FEEDING SHEETS OF DIFFERENT RIGIDITY

BACKGROUND OF THE INVENTION

1. Field of the Invention

The present invention relates to a cut sheet feeder for a word processor, an electrophotographic copier, a printer, a facsimile machine or another image forming apparatus.

2. Description of Related Art

For example, the assignee's Japanese Patent Application Laid-Open No. 7-304527 discloses a conventional printer, which includes an operation panel formed in a front portion of the top of its housing. A sheet cassette is positioned in the rear of the panel, and held removably in an backwardly inclined position by the housing. A cut sheet of paper can be fed from the cassette toward a print unit (image forming unit), which is supported in the housing.

The sheet cassette includes a support plate, which is urged upward. The cassette also includes a bottom support in the form of a bank. The front or lower ends of the sheets stacked on the support plate are stopped by the bottom support. Semi-cylindrical pickup rollers are supported downstream from the bottom support, and can be turned intermittently. A holder is urged toward and radially of the rollers, and includes a separation pad, which has a high friction factor, for contact with the cylindrical surfaces of the rollers. The front ends of the sheets on the support plate can be separated one by one, and the sheets can then be fed one after one toward the print unit.

However, if thick post cards, envelopes or other relatively rigid sheets are stacked in the cassette, their front ends may be stopped by the rear end face of the holder, and may not transfer or move smoothly onto the upper surface of the holder. Consequently, the sheets may not be fed smoothly by the turning of the pickup rollers.

SUMMARY OF THE INVENTION

It is an object of the invention to provide a sheet feeder which can feed sheets of paper securely by changing its condition of holding their front ends, selectively for soft sheets or relatively rigid sheets such as envelopes.

In accordance with a first aspect of the invention, a sheet feeder is provided for feeding sheets of paper one by one. The feeder includes a support plate on which the sheets can be stacked. The plate cooperates with a feed roller to nip between them the sheets stacked on the plate. The roller can feed the top one of the stacked sheets. A first support surface supports the front ends of the stacked sheets. A second support surface is lower in frictional resistance than the first surface. The second surface can move between a first position and a second position. In the first position, the second surface is protruded from the first surface toward the sheets. In the second position, the second surface is retracted from the first surface away from the sheets.

The first support surface may be a separating surface for separating the stacked sheets from one another. The second support surface may be an auxiliary holding surface.

The first support surface is relatively high in frictional resistance. Therefore, if relatively rigid sheets of paper are supported on this surface, the top one of them is difficult to feed from there. In this case, the second support surface is moved to the first position, where it is protruded from the first surface toward the sheets to support, in place of the first surface, their front ends. Because the second surface is lower in frictional resistance than the first surface, the feeding force of the feed roller can easily feed the top one of the sheets on the second surface downstream from there.

If relatively soft sheets of paper are supported on the first support surface, which is relatively high in frictional resistance, the top one of them is easy to separate from the next one and feed downstream. In this case, the second support surface, which is relatively low in frictional resistance, is in the second position, where it is retracted from the first surface away from the sheets.

The second support surface may be turned between the first and second positions by a rotatable shaft, which may be driven by an operating lever. This surface may be formed on one side of an arm fixed to the shaft. If the sheets are relatively rigid, the user can operate the lever to turn the second surface to the first position, where this surface supports the front ends of the sheets. If the sheets are relatively soft, the lever can be operated to turn the second surface to the second position so that the first surface supports the front ends of the sheets. This makes it possible to feed the sheets smoothly, whether they are rigid or soft. The shaft and the lever may be interconnected by a linkage. When the second surface is in the first position, it may be substantially parallel with the first surface to feed the sheets more smoothly.

The support plate may be urged toward the feed roller by a spring. Even if the number of stacked sheets decreases, the spring presses the sheets always against the roller so that the roller can slide the top sheet well. The plate may be part of a hopper. The rotatable shaft for the second support surface may be supported rotatably at one end of the plate. This fixes the position or the angle of the second surface relative to the plate end (bottom). Therefore, even if the number of stacked sheets varies, the resistance of the top sheet being fed does not change. Likewise, the first surface is positioned at the plate end. Therefore, likewise, when soft sheets are fed, the feed resistance is constant.

In accordance with a second aspect of the invention, a recorder is provided, which includes a support plate on which sheets of paper can be stacked. The plate cooperates with a feed roller to nip between them the sheets stacked on the plate. The roller can feed the top one of the stacked sheets one by one. A recording head is positioned downstream from the roller. A first support surface supports the front ends of the stacked sheets. A second support surface is lower in frictional resistance than the first surface. The second surface can move between a first position, where it is protruded from the first surface toward the sheets, and a second position, where it is retracted from the first surface away from the sheets.

The front ends of the stacked sheets can be supported selectively by one of the first and second support surfaces of this recorder. Therefore, the feed roller can feed the sheets smoothly toward the recording head, whether the sheets are rigid or soft.

The recorder may be a word processor, a printer such as an ink jet printer, a facsimile or a typewriter.

BRIEF DESCRIPTION OF THE DRAWINGS

A preferred embodiment of the invention will be described below with reference to the accompanying drawings, in which.

DETAILED DESCRIPTION OF A PREFERRED EMBODIMENT

Figure 1:
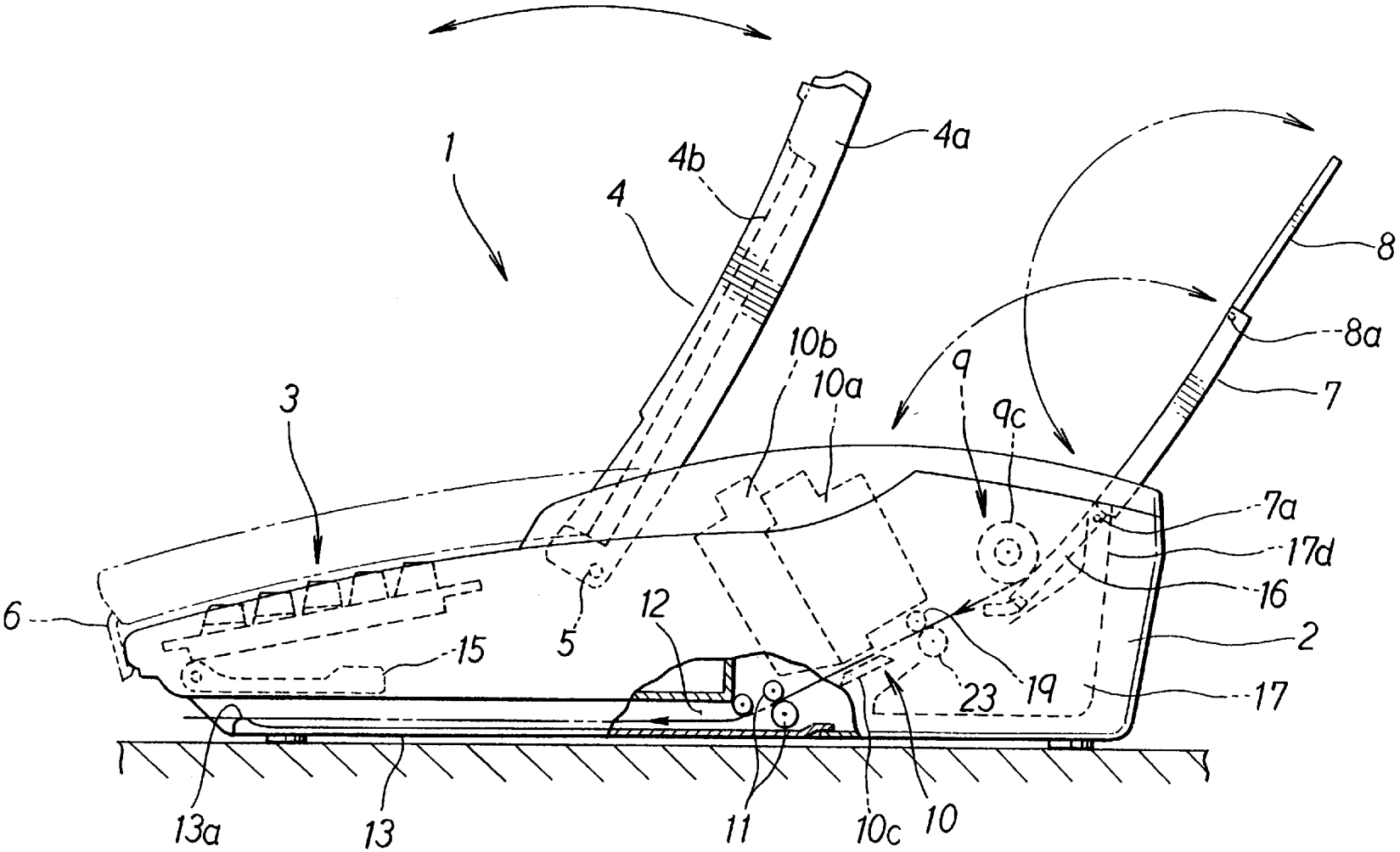
FIG. 1 is a partially broken side view of a portable word processor according to the embodiment.
Figure 2:
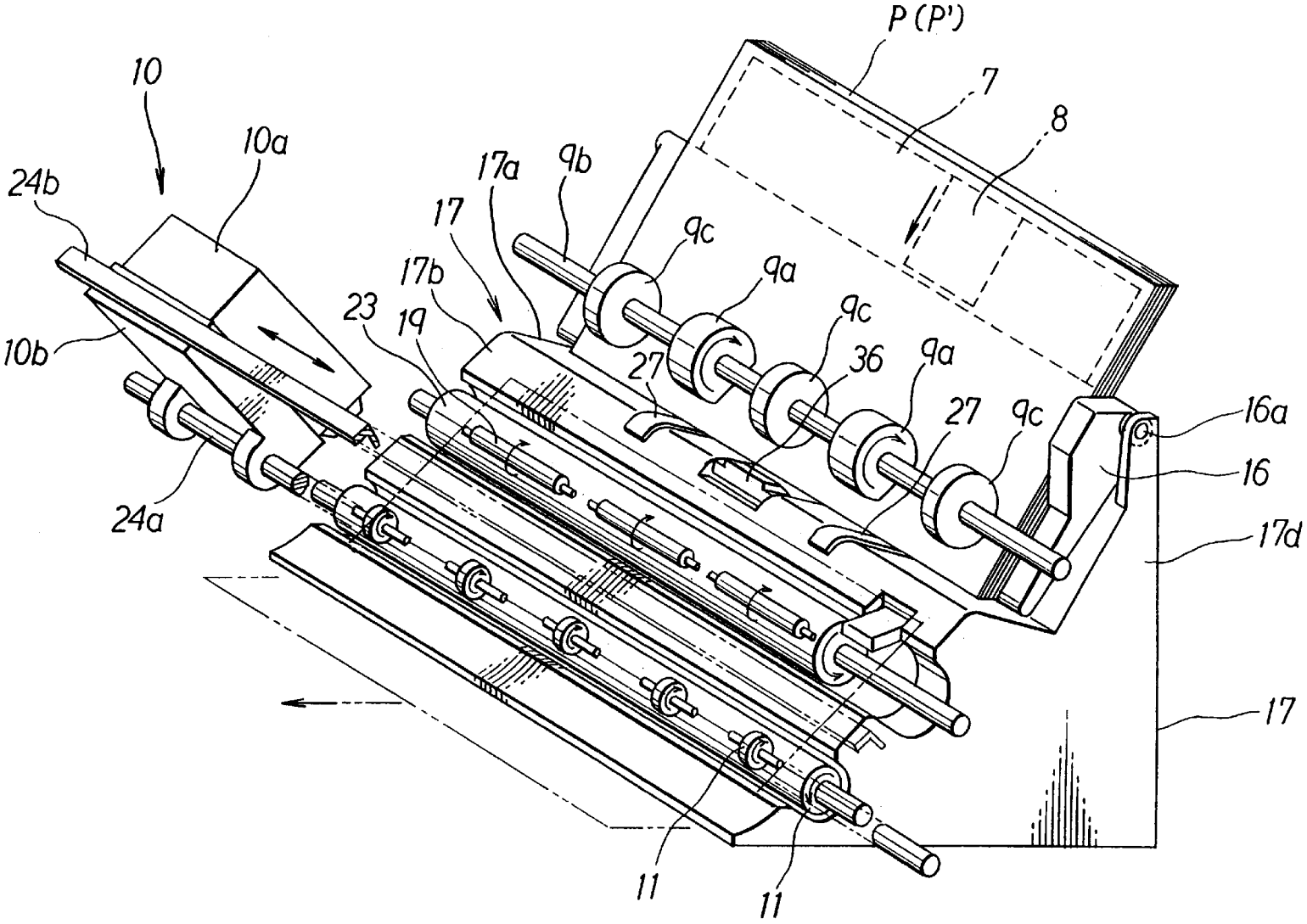
FIG. 2 is a schematic perspective view of the sheet feeder and the print unit of the word processor shown in FIG. 1.
Figure 3:
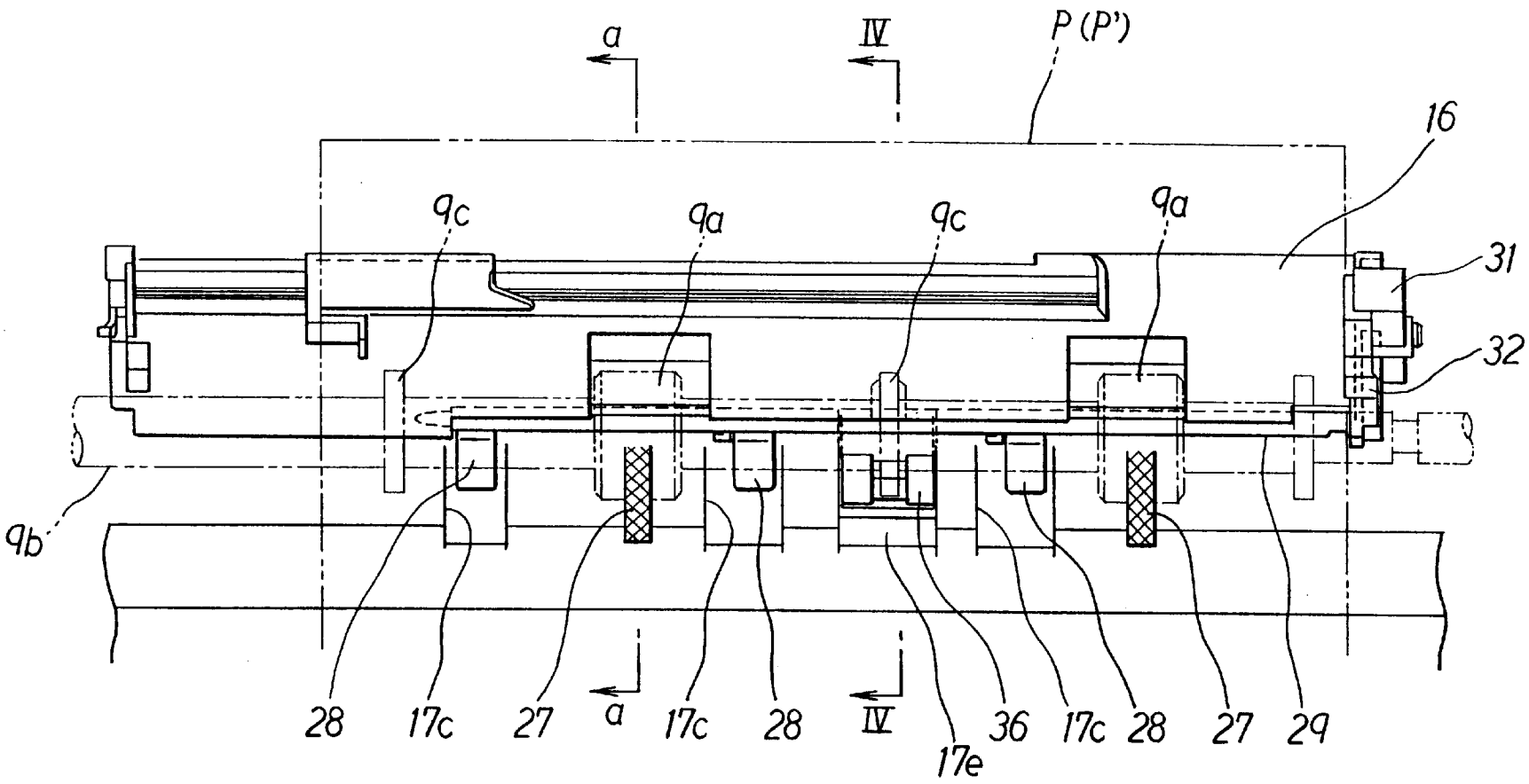
FIG. 3 is a front view of the sheet feeder shown in FIG. 1.

With reference to FIGS. 1–3, a portable word processor 1 embodying the invention includes a housing 2, which may be made of synthetic resin. Various keys are arranged in a key entry area 3, which is formed at the top of a front portion of the housing 2.

A display unit 4 includes a liquid crystal display 4*b*. The back of the display 4*b* is covered with a cover 4*a*, which may be made of synthetic resin. The display unit 4 is supported at its one end pivotably through a horizontal shaft 5 by the housing 2 in the rear of the entry area 3. While the word processor 1 is used, the display unit 4 can be kept open in a backwardly inclined position as shown with solid lines in FIG. 1. While the processor 1 is not used or is carried, the display unit 4 can be closed with its display 4*b* positioned over the entry area 3 and protected by the cover 4*a*, as shown with two-dot chain lines in FIG. 1. The free end of the display unit 4 can be fastened through a hook 6 to the front end of the housing 2.

Positioned in the rear of the display unit 4 is a main flat feed tray 7, which is supported on the top of the rear end of the housing 2. The tray 7 can be stacked with cut sheets of paper P in an inclined position as shown in FIGS. 1 and 2. A sheet feeder 9 is mounted in the housing 2 below and in front of the tray 7. A print unit 10 is supported in front of the feeder 9. The feeder 9 can separate one by one the sheets P stacked on the tray 7, and feed the separated sheets one after one toward the print unit 10. The feeder 9 includes a cylindrical feed roller 23 supported rotatably on a horizontal axis by the housing 2. The lower ends of the stacked sheets P can be held and guided by a support 17, which is fixed to the housing 2. The feed roller 23 is positioned at a downstream portion of the support 17.

Figure 4:
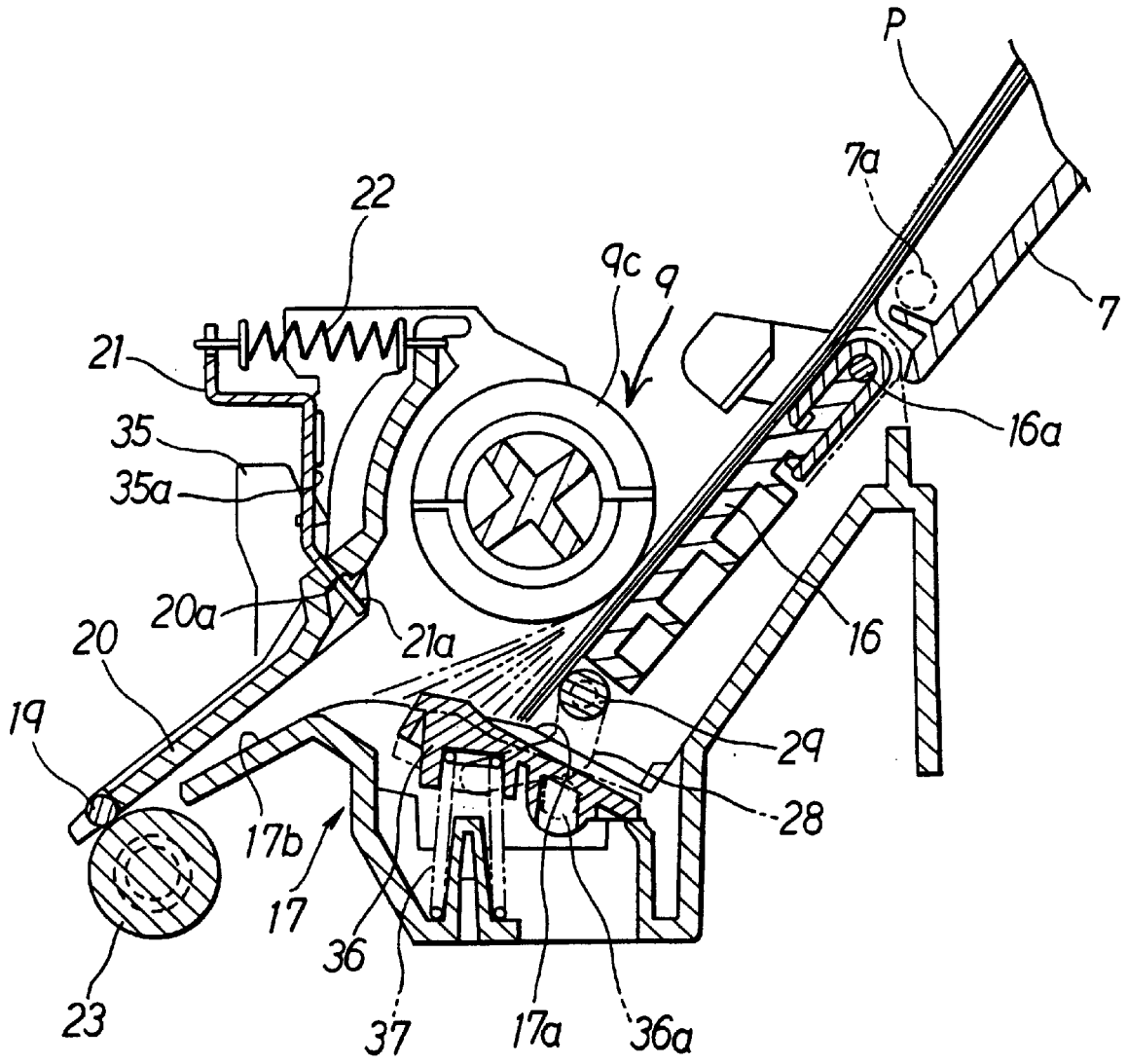
FIG. 4 is an enlarged cross section taken along line IV—IV of FIG. 3.

With reference to FIGS. 2–4, the support 17 has a holding surface 17*a* and a guide surface 17*b* in front of the holding surface. The sheet feeder 9 includes a hopper plate 16 supported between the lower end of the tray 7 and the holding surface 17*a*. The hopper plate 16 inclines generally in parallel to the opened display unit 4. The holding surface 17*a* inclines generally perpendicularly to the inclination of the hopper plate 16. The guide surface 17*b* inclines from the holding surface 17*a* forward and downward toward the top of the cylindrical feed roller 23.

The holding surface 17*a* has three recesses 17*c* and a recess 17*e* which are formed in it at suitable intervals between its right and left sides. Stuck to the surfaces 17*a* and 17*b* are two separating strips or sheets 27 at a suitable interval between the right and left sides of the support 17. Each separating strip 27 extends in both surfaces 17*a* and 17*b*. The separating strips 27 are made of material having a high friction factor, and have high slide resistance.

Figure 6A:
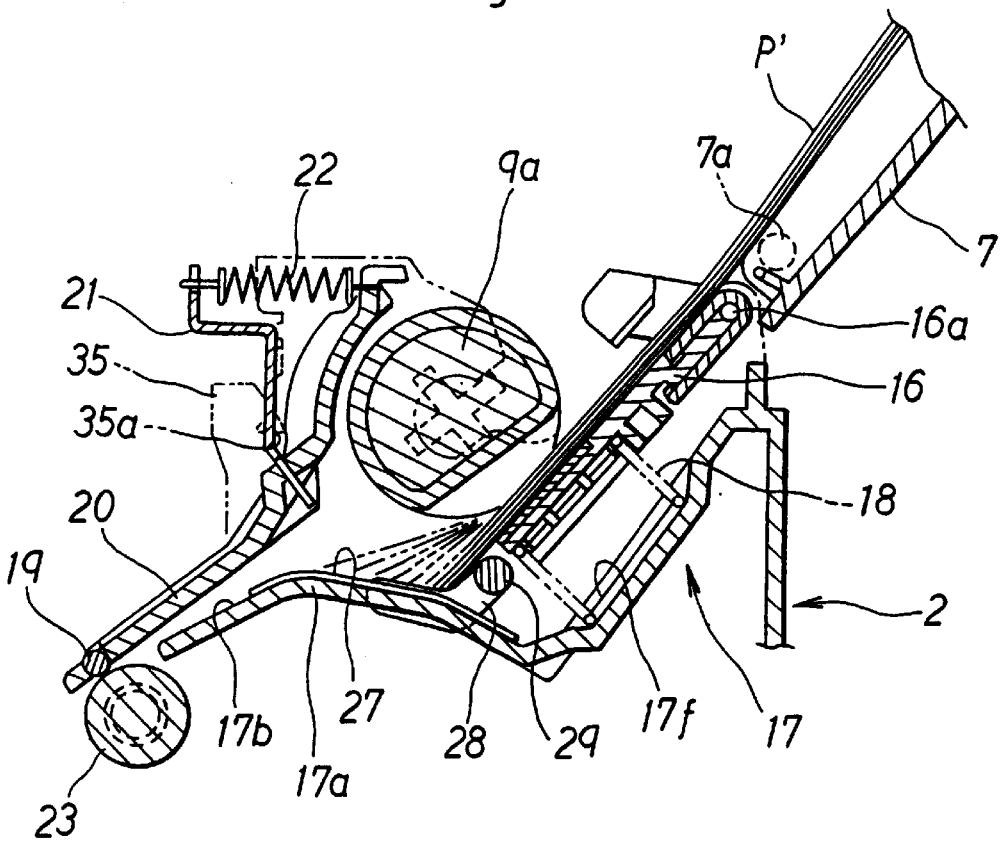
FIG. 6A is another cross section taken along line a—a of FIG. 3, with the auxiliary holders protruded.

The feeder 9 includes a drive shaft 9*b* supported rotatably by the housing 2 and extending in parallel to the axis of the cylindrical feed roller 23. The feeder 9 also includes two semi-cylindrical feed rollers 9*a* and three guide rollers 9*c*. The rollers 9*a* and 9*c* are fixed to the shaft 9*b*. The hopper plate 16 includes a pair of horizontal pins 16*a* formed on the right and left sides of its top. The support 17 includes a pair of supporters 17*d* formed on the right and left sides of its top. Each of the pins 16*a* is supported rotatably on one of the supporters 17*d*. The support 17 has a recess 17*f* (FIG. 6A). A compression spring 18 extends between the recess 17*f* and the hopper plate 16 to urge the free end of this plate 16 toward the rollers 9*a* and 9*c*.

The cylindrical surface of each semi-cylindrical feed roller 9*a* has a high coefficient of friction. When the sheet feeder 9 turns clockwise in FIGS. 1 and 4, they can separate the stacked sheets P one by one and feed them downward and forward along the guide surface 17*b* of the support 17, while pressing the sheets on the hopper plate 16.

As shown in FIGS. 3–6B, a shaft 29 extends in parallel to the drive shaft 9*b*, and is supported rotatably on the bottom of the hopper plate 16, which may have U-shaped bearings formed on its bottom to support the shaft 29. Each of three auxiliary holders 28 is fixed at its one end to the shaft 29. As shown in FIG. 3, the holders 28 are positioned at the recesses 17*c* of the support 17. The holders 28 are shaped generally like an L, and their free ends can protrude selectively above the holding surface 17*a*. The holders 28 may be made of synthetic resin, and their surfaces are low in frictional resistance. One end of a link 32 is fixed to one end of the shaft 29, and has a generally circular or arcuate guide groove 32*a* formed in it.

Figure 5A:
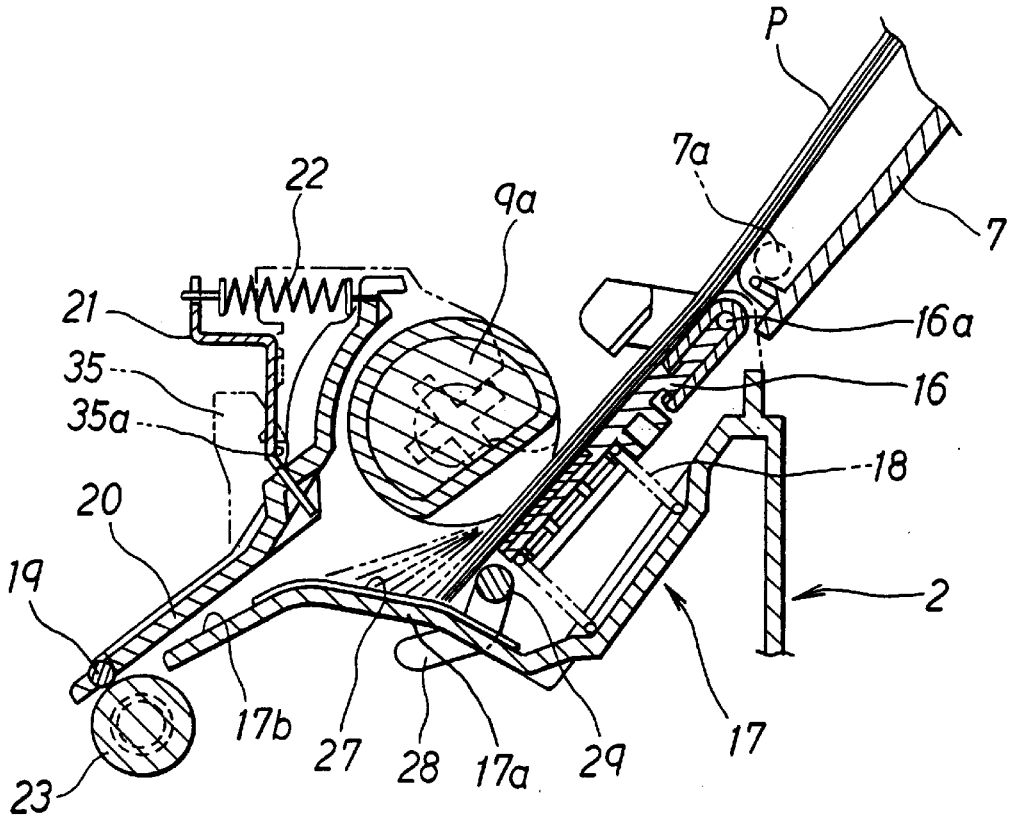
FIG. 5A is a cross section taken along line a—a of FIG. 3, with the auxiliary holders retracted.
Figure 5B:
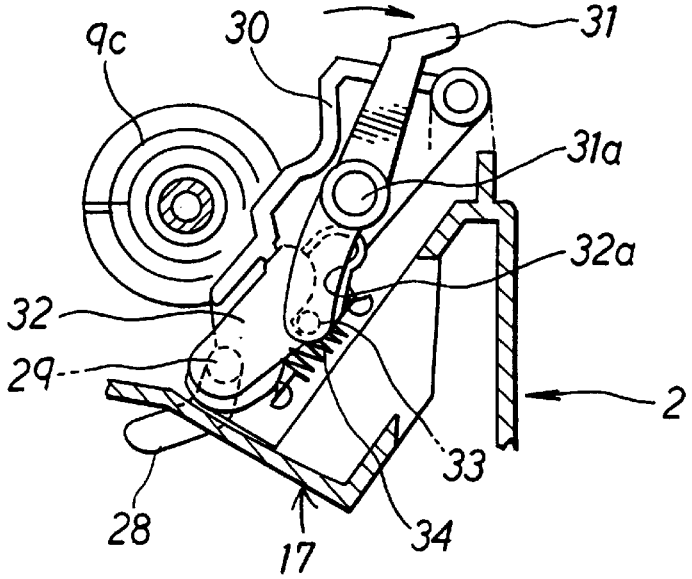
FIG. 5B is a cross section showing the positions of the operating lever and the link mechanism of the sheet feeder with the auxiliary holders retracted.
Figure 6B:
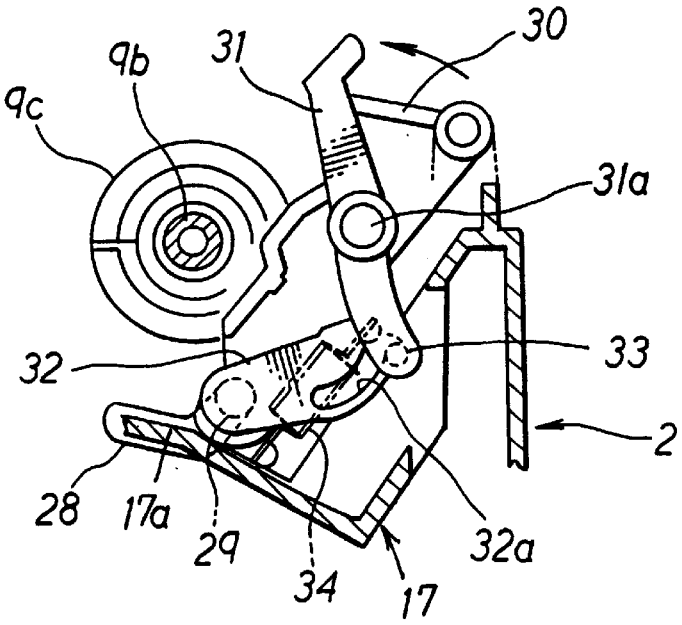
FIG. 6B is a cross section showing the positions of the operating lever and the link mechanism with the auxiliary holders protruded.

As shown in FIGS. 5B and 6B, the support 17 includes a bracket 30 formed on its one side. An operating lever 31 is supported on its horizontal axis 31*a* rotatably by the bracket 30. The lever 31 includes a horizontal pin 33 formed on its one end. The pin 33 engages slidably with the guide groove 32*a* of the link 32. A tension spring 34 extends between the bracket 30 and the link 32.

If the operating lever 31 is turned clockwise, as shown in FIG. 5B, the link 32 pivots counterclockwise until it is stopped by the bracket 30. This turns the shaft 29 and, as shown in FIGS. 5A and 5B, retracts free end portions of the auxiliary holders 28 below the holding surface 17*a*. When the link 32 is in contact with the bracket 30, the line of action of the tension spring 34 extends below the lever pin 33 so that the free end portions of the holders 28 are positioned below the holding surface 17*a* as shown in FIGS. 6A and 6B.

If the lever 31 turns counterclockwise, as shown in FIG. 6B, the link 32 pivots and the shaft 29 turns clockwise until the lever pin 33 is stopped by that end of the link groove 32*a* which is remote from the shaft 29. This positions the line of action of the tension spring 34 above the lever pin 33, thereby keeping part of each holder 28 protruded above the holding surface 17*a*.

By turning the lever 31, it is possible to select the position of the auxiliary holders 28 relative to the holding surface 17*a*. The upper surface of each holder 28 is low in slide resistance.

As shown in FIG. 4, the housing 2 includes a pair of supporters 35 protruding on the right and left sides of the top of its rear portion. The right and left ends of a long support panel 21 are supported removably on the supporters 35 in front of the rollers 9*c*. The panel 21 has tongues 21*a* protruding downward from its bottom. A guide plate 20 has holes 20*a* formed through it, each of which is in engagement with one of the tongues 21*a* in such a manner that the plate 20 can turn relatively to the panel 21. Three pinch rollers 19 are supported rotatably on an axis in parallel to the cylindrical feed roller 23 by one end portion of the plate 20. Compression springs 22 extend between the other end of the plate 20 and the panel 21 to urge the pinch rollers 19 generally downward on this feed roller 23. The feed roller 23 can be driven by a driving device like a driving motor (not shown).

As shown in FIG. 2, the print unit 10 includes a print head 10*a*, which may be an ink jet head. The head 10*a* is mounted on a carriage 10*b*, which can slide on and along a guide shaft 24*a* and a guide bar 24*b*. The carriage 10*b* can be driven by a timing belt (not shown) and a driving device like the driving motor (not shown). The shaft 24*a* and the bar 24*b* extend in parallel to the feed roller 23 etc., and are fixed to the housing 2. A platen 10*c* in the form of a plate extends in parallel to the feed roller 23 etc., and is supported downstream from this roller 23 by the housing 2. A cut sheet of paper P is printed while it is moving between the head 10*a* and the platen 10*c*.

Positioned under the print unit 10 are discharge rollers 11 and a discharge port 12 in the housing 2. These rollers 11 are supported rotatably on axes in parallel to the feed roller 23 etc. As shown in FIG. 1, a flat discharge tray 13 extends horizontally between a position near the bottom of the port 12 and a position near the front end of the housing 2. The tray 13 is spaced suitably from the bottom of the housing 2. A cut sheet of paper P can move from the port 12 to the front end 13*a* of the tray 13, from which it can be taken out.

With reference to FIG. 1, a carrying handle 15 includes a horizontal or intermediate bar and a pair of arms each extending from one end of the bar. The other ends of the arms are supported rotatably on a horizontal axis by the bottom of the front end of the housing 2. The housing 2 has a groove or recess (not shown) formed in its bottom for engagement with the handle 15. When positioned in the groove, the handle 15 does not interfere with the sheet P being discharged.

As shown in FIGS. 1, 2 and 4, the main feed tray 7 has a pair of horizontal pins 7*a* formed on the right and left sides of its one end. The pins 7*a* are supported rotatably on the top of the rear end of the housing 2. While the word processor 1 is used, the tray 7 can be held in an inclined position with its free end above and in the rear of the pins 7*a*. The tray 7 can also be held in a position substantially in parallel to the top of the housing 2 and over the support 17.

The main feed tray 7 supports an auxiliary feed tray 8 midway between its right and left sides. This tray 8 has a pair of horizontal pins 8*a* formed on the right and left sides of its one end. The pins 8*a* are supported rotatably on the top of the main tray 7. The auxiliary tray 8 can be held selectively in an erected position as shown in FIG. 1 or a folded position. In the erected position, the auxiliary tray 8 extends from the top of the erected main tray 7 at the same angle as the main tray is inclined. In this position, the auxiliary tray 8 can support rear portions of long or large sheets P stacked on the main tray 7. In the folded position, the auxiliary tray 8 lies on the front (upper) side of the main tray 7.

The sheet feeder 9 operates as follows. With reference to FIGS. 5A and 5B, for weak or soft cut sheets P such as ordinary printing sheets, the operating lever 31 is turned clockwise to keep the free end portions of the auxiliary holders 28 retracted below the holding surface 17*a* of the support 17 and the upper surfaces of the separating strips 27. With the holders 28 in this position, the lower ends of the sheets P stacked on the feed tray 7 and the hopper plate 16 are in contact with the separating strips 27.

The support 17 supports a stopper 36 at its recess 17*e*. As shown in FIG. 4, the stopper 36 has a pair of horizontal pins 36*a*, which are supported rotatably on the support 17. A weak compression spring 37 extends between one end of the stopper 36 and the support 17 to urge this end upward. Normally, part of the stopper 36 protrudes above the holding surface 17*a* of the support 17 and the separating strips 27 to keep the lower ends of the stacked sheets P from slipping toward the guide surface 17*b* until the sheets are fed.

When the word processor 1 starts printing, with the auxiliary holders 28 retracted as shown in FIG. 5A, the semi-cylindrical feed rollers 9*a* start to turn clockwise in FIG. 5A. This starts to slide the lower end of the top one of the stacked weak sheets P against the resistance of the separating strips 27. Continued turning of the rollers 9*a* slides the sheet end on the protruding part of the stopper 36 and onto the guide surface 17*b*. When the sheet is pinched between the turning cylindrical feed roller 23 and pinch rollers 19, it can be fed securely toward the print unit 10.

With reference to FIGS. 6A and 6B, for relatively rigid or strong cut sheets of paper P' such as envelopes and post cards, the operating lever 31 is turned counterclockwise to keep part of each auxiliary holder 28 protruding above the holding surface 17*a* and the separating strips 27. Consequently, the lower ends of the sheets P' stacked on the feed tray 7 and the hopper plate 16 rest on the holders 28, and are prevented from contacting the separating strips 27.

When the word processor 1 starts printing, with the auxiliary holders 28 protruding, the semi-cylindrical feed rollers 9*a* start to turn clockwise in FIG. 6A. As a result, the lower end of the top one of the stacked strong sheets P' starts to move from the holders 28 to the guide surface 17*b* of the support 17 due to the relatively low frictional resistance of the surface of the holder 28 without touching the separating strips 27. When the sheet is pinched between the turning cylindrical feed roller 23 and pinch rollers 19, it can be fed securely toward the print unit 10.

Thus, by simply turning the operating lever 31, it is possible to adjust or change the condition of the holding surface 17*a* selectively for either weak or strong sheets of paper.

The shaft 29 supporting the auxiliary holders 28 is supported rotatably by the bottom of the hopper plate 16, which can pivot depending on the number of sheets stacked on it. Therefore, even if the number of stacked sheets varies, the holders 28 can securely hold the lower ends of the sheets when they are protruded, and their free end portions are completely away from the sheet ends when they are retracted.

Of course, the structure of the sheet feeder 9 might be applied to copying machines, printers, facsimile machines and other image forming apparatus.

What is claimed is:

1. A sheet feeder for feeding sheets of paper one by one, comprising:

a support plate on which the sheets can be stacked;

a feed roller for cooperating with the plate to nip therebetween the sheets stacked on the plate, and for feeding the top one of the stacked sheets;

a first support surface which supports the front ends of the stacked sheets; and a second support surface which has a different frictional resistance than the first surface, the second surface being movable between a first position where the second surface is protruded from the first surface toward the sheets to support the front ends of the stacked sheets and a second position where the second surface is retracted from the first surface away from the sheets.

2. The sheet feeder as defined in claim 1, and further comprising a rotatable shaft for turning the second support surface between the first and second positions, and an operating lever for driving the shaft.

3. The sheet feeder as defined in claim 2, wherein, if the stacked sheets are rigid, the operating lever is operated to turn the second support surface to the first position so that the second surface supports the front ends of the sheets.

4. The sheet feeder as defined in claim 2, wherein, if the stacked sheets are soft, the operating lever is operated to turn the second support surface to the second position so that the first support surface supports the front ends of the sheets.

5. The sheet feeder as defined in claim 2, and further comprising a linkage interconnecting the rotatable shaft and the operating lever.

6. The sheet feeder as defined in claim 1, wherein the second support surface is substantially parallel to the first support surface when the second surface is in the first position.

7. The sheet feeder as defined in claim 1, and further comprising a spring urging the support plate toward the feed roller.

8. The sheet feeder as defined in claim 7, wherein the support plate inclines in such a manner that the sheets are stacked thereon in an inclined position with the front ends thereof down, the first support surface being formed at the bottom of the plate.

9. The sheet feeder as defined in claim 8, wherein the rotatable shaft is supported rotatably at the bottom of the support plate.

10. The sheet feeder as defined in claim 1, and further comprising an arm one end of which is fixed to the rotatable shaft, the second support surface being formed on one side of the arm.

11. The sheet feeder as defined in claim 1, wherein part of the first support surface is covered with a frictionally resistant material.

12. A recorder comprising:

a support plate on which sheets of paper can be stacked;

a feed roller for cooperating with the plate to nip therebetween the sheets stacked on the plate, and for feeding the top one of the stacked sheets one by one;

a recording head positioned downstream from the roller;

a first support surface which supports the front ends of the stacked sheets; and a second support surface which has a different frictional resistance than the first surface, the second surface being movable between a first position where the second surface is protruded from the first surface toward the sheets to support the front ends of the stacked sheets and a second position where the second surface is retracted from the first surface away from the sheets.

13. The recorder as defined in claim 12, and further comprising a rotatable shaft for turning the second support surface between the first and second positions, and an operating lever for driving the shaft.

14. The recorder as defined in claim 13, wherein, if the stacked sheets are rigid, the operating lever is operated to turn the second support surface to the first position so that the second surface supports the front ends of the sheets.

15. The recorder as defined in claim 13, wherein, if the stacked sheets are soft, the operating lever is operated to turn the second support surface to the second position so that the first support surface supports the front ends of the sheets.

16. The recorder as defined in claim 13, and further comprising a linkage interconnecting the rotatable shaft and the operating lever.

17. The recorder as defined in claim 12, wherein the second support surface is substantially parallel to the first support surface when the second surface is in the first position.

18. The recorder as defined in claim 12, and further comprising a spring urging the support plate toward the feed roller.

19. The recorder as defined in claim 18, wherein the support plate inclines around a horizontal axis, the first support surface being formed at the bottom of the plate.

20. The recorder as defined in claim 18, wherein the rotatable shaft is supported rotatably at one end of the support plate.

21. The recorder as defined in claim 12, wherein the recording head is an ink jet head.

22. The sheet feeder as defined in claim 1, wherein the second support surface is lower in frictional resistance than the first support surface.

23. The recorder as defined in claim 12, wherein the second support surface is lower in frictional resistance than the first support surface.

* * * * *